US006357241B1

(12) United States Patent
Dudley

(10) Patent No.: US 6,357,241 B1
(45) Date of Patent: Mar. 19, 2002

(54) METHOD OF CONTROLLING REFRIGERANT CYCLE WITH SEALED SUCTION PRESSURE SENSOR

(75) Inventor: Eliot W. Dudley, Cato, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/746,160

(22) Filed: Dec. 22, 2000

(51) Int. Cl.[7] ..... F25B 49/02
(52) U.S. Cl. ..... 62/126; 62/217
(58) Field of Search ..... 62/125, 126, 127, 62/129, 217

(56) References Cited

U.S. PATENT DOCUMENTS 4,660,386 A * 4/1987 Hansen et al. ..... 62/126
4,848,096 A * 7/1989 Funahashi et al. ..... 62/126
5,163,301 A * 11/1992 Cahill-O'Brien et al. ..... 62/217
5,907,957 A * 6/1999 Lee et al. ..... 62/217
6,138,467 A * 10/2000 Lifson et al. ..... 62/217

* cited by examiner

*Primary Examiner*—Harry B. Tanner
(74) *Attorney, Agent, or Firm*—Carlson, Gaskey & Olds

(57) ABSTRACT

An improved controlled algorithm for a refrigerant cycle monitors a suction pressure sensor to ensure the suction pressure sensor continues to operate. The controller utilizes a detected suction pressure to assure the suction pressure does not drop below a minimum value, which could result in undesirable conditions within the refrigerant cycle. The controller also monitors the suction pressure sensor signal to ensure the suction pressure sensor is operating properly. If the suction pressure sensor fails, then a control algorithm is utilized wherein a minimum open percentage is set for a suction modulation valve, and the suction modulation valve is not allowed to close beyond the minimum suction modulation valve percentage opening.

9 Claims, 2 Drawing Sheets

METHOD OF CONTROLLING REFRIGERANT CYCLE WITH SEALED SUCTION PRESSURE SENSOR

BACKGROUND OF THE INVENTION

This invention relates to a method of operating a refrigerant cycle with a failed suction pressure sensor to ensure that undesirably low suction pressures do not occur.

Moderate refrigerant cycles are typically controlled by microprocessor control algorithms. A number of variables are taken in as feedback, and utilized to determine optimum conditions for the various components in the refrigerant cycle. One type of refrigerant cycle which has had a good deal of recent development of such controls is a refrigerant cycle for large refrigerated transport vehicles. These transport vehicles are utilized to transport frozen or perishable items, and typically food stuffs.

The refrigeration of such containers is particularly challenging when perishable items are being stored in the containers. Perishable items are not kept frozen, but must be kept within a very tight temperature band. Such systems attempt to control the temperature by controlling the various components in the refrigeration cycle. Among the components which are typically controlled are the refrigerant compressor and a suction modulation valve (SMV).

During this control, it is possible that the suction pressure can drop to undesirably low values at the compressor. One problem that can occur if the suction pressure is undesirably low is that there could be Corona discharge across high voltage terminals in the motor which drives the compressor. This is undesirable, but will typically not occur if the suction pressure is above 1.0 psia.

Thus, the prior art has incorporated controls including a suction pressure sensor that ensures the suction pressure does not fall below this amount. The control monitors the suction pressure and if the suction pressure went below a predetermined amount approaching 1.0, then the control for the system takes steps to ensure the suction pressure does not continue to drop.

If the suction pressure sensor fails, the prior art system was turned off. Users of the refrigerant equipment developed methods for replacing the suction pressure sensor input to the controller. Thus, a "false" signal would be sent to the controller to replace the missing signal from the failed sensor. Of course, such a method of replacing a valid signal with a false signal eliminates the protection provided by the control algorithm.

The present invention is directed to a method that will allow continued operation of the system even when the suction pressure sensor fails.

SUMMARY OF THE INVENTION

In the disclosed embodiment of this invention, a controller for a refrigerant cycle continues to operate essentially as in the prior if a valid suction pressure signal is received. However, in a preferred embodiment, if a valid pressure sensor signal is not received, then the system moves into a mode wherein a minimum open percentage for an SMV is maintained. Applicant has determined that the suction pressure varies with the percentage that the SMV is open. For a given ambient temperature, a minimum SMV open percentage can be defined to ensure that the suction pressure will not drop below a predetermined amount.

Most preferably, this minimum open percentage is set to provide a large margin of error such that any unpredicted variables will still not result in the suction pressure dropping below the 1.0 psia number mentioned above.

This invention thus sets the SMV percentage open number as a minimum in a situation where the suction pressure sensor has failed, and does not close the SMV even if the control algorithm would suggest further closing of the SMV beyond this number.

Most preferably this system is incorporated into a refrigerant cycle for a refrigerated container.

BRIEF DESCRIPTION OF THE DRAWINGS

These and other features of the present invention can be best understood from the following specification and drawing, and following which is a brief description.

DETAILED DESCRIPTION OF THE PREFERRED EMBODIMENT

Figure 1:
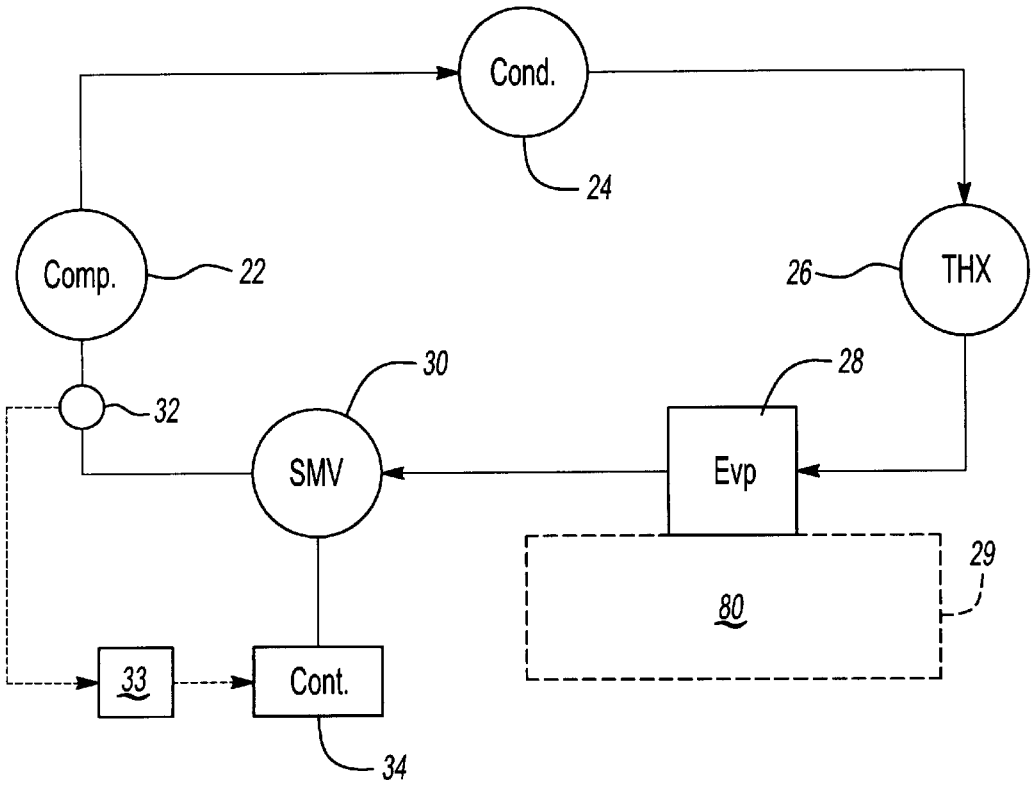
FIG. 1 is a schematic view of a refrigerant cycle.

FIG. 1 shows a refrigerant cycle 20 incorporating a compressor 22 sending a compressed refrigerant to a condenser 24. An expansion valve 26 receives refrigerant from the condenser 24 and delivers the refrigerant to an evaporator 28. As shown, the evaporator 28 cools the temperature within a container 29. As mentioned above, the container 29 is preferably a transport refrigerated container 80 for storing items such as food stuffs. Of course, the cycle is shown schematically. Refrigerant from the evaporator passes to a computer controlled SMV 30. A suction pressure sensor 32 is placed on a line between the SMV 30 and the compressor 22. A circuit 33 monitors the voltage from the sensor 32. If the voltage sensed by circuit 33 is outside of a range, then a decision may be made at a controller 34 that the suction pressure sensor 32 has failed. In essence, if the voltage signal from the sensor is too low or too high, a decision can be made that it could not be properly identifying the suction pressure. A worker of ordinary skill in this art would recognize how to provide such a control feature.

During normal operation, the controller 34 controls the several components in the cycle 20 to achieve optimum operation. Among the components which are controlled is the SMV 30. The SMV is closed to lower the cooling load performed. As mentioned above, and in particular in "perishable" cooling mode, a very tight band of temperatures is necessary within the container 29. Thus, the controller 34 may determine in its controlled algorithm to further close the SMV 30 to reduce the cooling load on the container 29.

Figure 2:
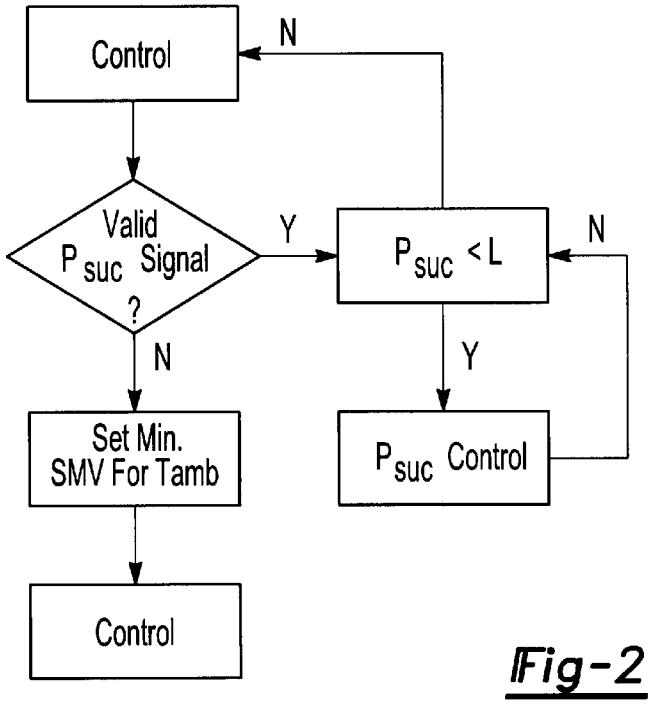
FIG. 2 is a flow chart.

As shown in FIG. 2, during this normal operation, the signal from the pressure sensor 32 is evaluated. The valid $P_{SUC}$ signal is compared to a predetermined minimum value to ensure the suction pressure is not dropping too low such that it could endanger the operation of the motor as described above. A known method of operating the SMV thus begins should the suction pressure drop below the predetermined amount L. If the system is in "perishable" cooling mode, there is typically active SMV modulation. In such a mode, it may be that the value L could be set to 3.5 psia. If the system is simply in frozen food cooling mode, there is less likelihood of the SMV being closed to such a small amount as would be necessary to result in a very low P suction. Thus, in such situations, the value L can be set lower, such as to 2.0 psia.

Thus, the prior art method essentially controlled the components to attempt to raise the suction pressure, should the $P_{SUC}$ signal indicate the suction pressure was dropping to undesirably low values.

The present invention adds a further step for the situation wherein there is no valid $P_{SUC}$ signal. In the prior art, the system was simply shut down. With this invention, a minimum SMV percentage opening is set for particular system operations.

Figure 3:
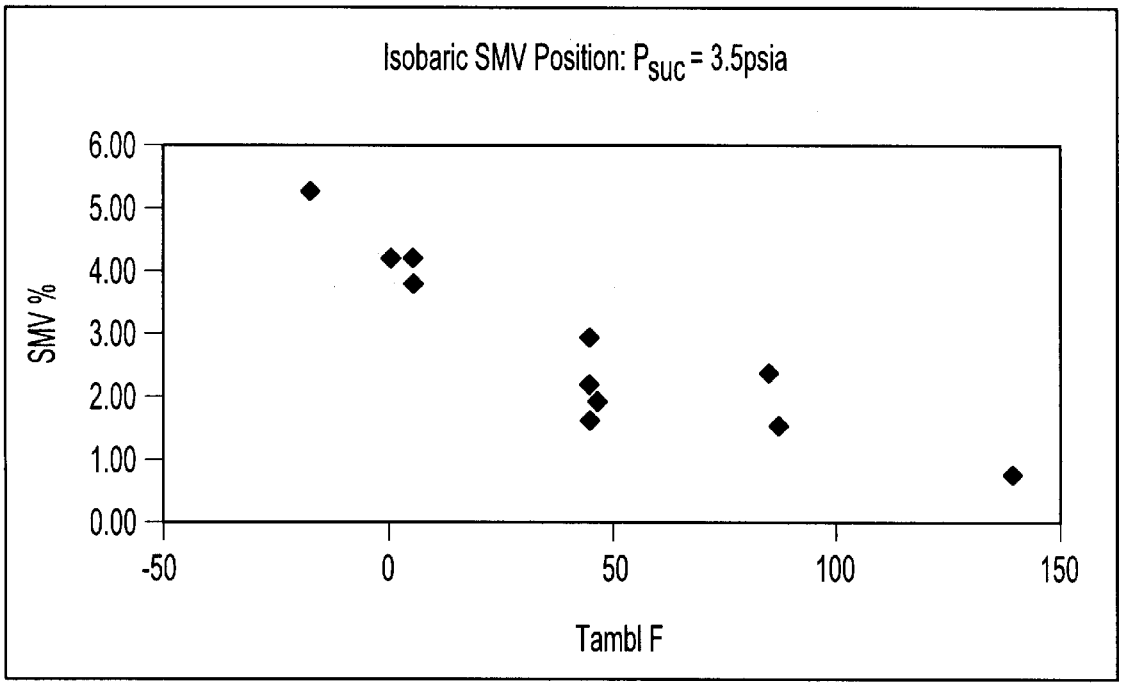
FIG. 3 is a chart showing the relationship of the opening percentage of an SMV and the ambient temperature.

FIG. 3 shows a number of points which vary with ambient temperature, and which show the percentage of opening of an SMV for maintaining a suction pressure PSUC of 3.5 psia. An equation could be developed that matches this gathered data. Applicant has determined that the data is relatively consistent in this regard. The data points illustrated in FIG. 3 show an $R^2$ value of 0.828, a slope of −0.028 and a 0° Fahrenheit temperature intercept of 4.126 SMV percentage open. A 99% confidence rate can be set that at any given ambient temperature, the $P_{SUC}$ will not drop below 3.5 psia with a margin of error of + or −0.82 SMV percentage opening. That is to say, the data points show a relatively high degree of predictability. By setting a minimum SMV percentage open for a particular ambient temperature, the present invention is thus able to ensure that the $P_{SUC}$ value will not drop below a predetermined low suction pressure amount, here 3.5 psia.

The present invention thus continues to monitor whether a valid $P_{SUC}$ signal is being received. If not, then the system enters into a mode of operation wherein a minimum SMV percentage open is defined. Operation of the cycle 20 continues, however, the minimum SMV percentage open is set, and cannot be overridden by the controller. The controller will determine a desired SMV percentage opening given system conditions, however, if this desired percentage opening is less than the minimum, the minimum will be utilized.

While it is preferred that the minimum SMV open percentage be defined based upon a varying ambient temperature, it may also be that a preset and fixed minimum SMV open percentage could be defined. If the minimum SMV open percentage is variable with a condition, such as ambient temperature, then the control must either have access to a formula, or to a look-up table. A worker of ordinary skill in the art would recognize how to provide such control features based upon the above disclosure.

The present invention thus addresses the problem of the failed suction pressure sensor by setting a condition that is unlikely to result in an undesirably low suction pressure. Stated another way, the system includes a method of control wherein when it has been determined that the suction pressure sensor has failed, the system is not allowed to move to conditions that would likely result in the suction pressure sensor becoming undesirably low.

Although a preferred embodiment of this invention has been disclosed, a worker in this art would recognize the modifications that come within the scope of this invention. For that reason the following claims should be studied to determine the true scope and content of this invention.

What is claimed is:

1. A refrigerant cycle comprising:

a compressor in series with a condenser, an expansion valve, an evaporator, and a suction modulation valve;

a fluid line communicating said suction modulation valve to said compressor;

and a pressure sensor for sensing suction pressure in a refrigerant being delivered from said suction modulation valve to said compressor, a signal from said suction pressure sensor being sent to a controller, said controller controlling at least said suction modulation valve; and said controller being provided with an algorithm for ensuring that a minimum suction modulation valve percentage opening is set to ensure that a suction pressure will not drop below a minimum value.

2. A refrigerant cycle as recited in claim 1, wherein said set minimum suction modulation valve percentage opening is only utilized if an indication has been made that said pressure sensor has failed.

3. A refrigerant cycle as recited in claim 2, wherein a circuit evaluates the signal from said suction pressure sensor to determine if said suction pressure sensor has likely failed.

4. A refrigerant cycle as recited in claim 1, wherein said controller monitors an ambient temperature, and identifies said minimum suction modulation valve percentage opening based upon said detected ambient temperature.

5. A refrigerant cycle as recited in claim 1, wherein said evaporator cools a transport refrigerated container.

6. A method of operating a refrigerant cycle comprising the steps of:

1) providing the suction modulation valve for delivering suction pressure refrigerant to a compressor, and providing a suction pressure sensor for monitoring a suction pressure of said refrigerant, said refrigerant being delivered from said suction modulation valve to said compressor;

2) utilizing said suction pressure sensor to provide feedback of a suction pressure to a controller;

3) evaluating said suction pressure sensor to determine whether said suction pressure sensor has failed; and 4) incorporating a minimum suction modulation valve percentage opening into said controller, and utilizing said minimum suction modulation valve percentage opening in the event that a determination is made at step 3 that said suction pressure sensor has failed.

7. A method as set forth in claim 6, wherein said suction modulation valve and said compressor are incorporated into a refrigerant cycle for a refrigerated transport container.

8. A method as set forth in claim 6, wherein said minimum suction modulation valve percentage opening is based upon a sensed ambient temperature.

9. A refrigerant cycle comprising:

a compressor in series with a condenser, an expansion valve, an evaporator, and a suction modulation valve;

a fluid line communicating said suction modulation valve to said compressor;

a pressure sensor for sensing suction pressure in a refrigerant being delivered from said suction modulation valve to said compressor, a signal from said suction pressure sensor being sent to a controller, said controller controlling at least said suction modulation valve;

a circuit for evaluating a signal from said suction pressure sensor to determine if said suction pressure sensor has likely failed, and said controller being provided with an algorithm for ensuring that a minimum suction modulation valve percentage open mean is set to ensure that a suction pressure will not drop below a minimum value should a signal be received that said suction pressure sensor has failed, said minimum suction modulation valve percentage opening being utilized only in the event that a determination is made that said suction pressure sensor has failed, and said minimum suction modulation value percentage opening varying with a detected ambient temperature; and said refrigerant cycle being connected to cool a refrigerated transport container.

* * * * *